United States Patent [19]

McKenney

[11] 4,154,362

[45] May 15, 1979

[54] SELF-ATTACHING HINGE FOR POLYSTYRENE CONTAINERS AND LATCH MEANS INTEGRAL THEREWITH

[75] Inventor: Richard A. McKenney, Bristol, Conn.

[73] Assignee: Curtiscorp, Inc., Sandy Hook, Conn.

[21] Appl. No.: 905,391

[22] Filed: May 12, 1978

[51] Int. Cl.[2] ..... B65D 43/14; B65D 51/04

[52] U.S. Cl. ..... 220/334; 16/128 R; 16/171; 16/150; 16/159

[58] Field of Search ..... 220/334, 339; 16/128 R, 16/150, 171, 159

[56] References Cited

U.S. PATENT DOCUMENTS

| | | | |
|---|---|---|---|
| 3,592,354 | 7/1971 | Nielsen | 220/334 |
| 3,805,327 | 4/1974 | Walker | 16/159 |
| 4,089,467 | 5/1978 | McKenney | 220/334 |

*Primary Examiner*—George T. Hall

*Attorney, Agent, or Firm*—Wooster, Davis & Cifelli

[57] ABSTRACT

Polypropylene hinges include hinge mounts for self-attaching them to the box and cover of a polystyrene container. The hinge mounts depend from hinge plates and are characterized by an outwardly protruding rigidly supported flange. The hinge mounts are generally matingly received in openings in the box and cover, and the flanges deform the openings to create notches receiving the flanges in an interengaging fit. Hinges also releasably detain the box and cover in a closed position by means of locking legs upstanding from one hinge plate and releasably capturing the other hinge plate to hold the hinge plates in a closed position. In a preferred embodiment, two locking legs having capture tabs receive the other hinge plate therebetween, the capture tabs capturing the other hinge plate to hold the hinge in its closed position.

17 Claims, 5 Drawing Figures

SELF-ATTACHING HINGE FOR POLYSTYRENE CONTAINERS AND LATCH MEANS INTEGRAL THEREWITH

BACKGROUND OF THE INVENTION

This invention relates to improved hinges in plastic containers made of polystyrene or the like, and particularly to improved hinges which are self-attaching to the container and which releasably detain the cover of a container in a closed position.

Molded polystyrene foam containers are widely used as containers. They are light weight and relatively inexpensive and can be molded to various desired shapes. For instance, products are often protected by molding a polystyrene container to their form.

Molded polystyrene containers have a substantial drawback in that the molded polystyrene is somewhat soft and incapable of supporting conventional hinges, latches or the like which require screws, rivets or other similar fasteners to secure them to the container. The molded polystyrene foam simply breaks away from such fasteners and will not hold them. Therefore, the tops and bottoms of molded polystyrene foam containers have usually been connected by tape or the like, which is not reusable and is otherwise unsatisfactory in many obvious respects.

Hinges and latches for polystyrene boxes are described in copending U.S. application Ser. No. 822,416 filed Aug. 8, 1977, now U.S. Pat. No. 4,089,467 granted May 16, 1978, assigned to the same assignee as this application. Those hinges provide a viable means of hingedly attaching a cover to a polystyrene container, although the hinges of the invention herein have improved self-attachment to the polystyrene container and its associated cover. The latches used to maintain the lid in its closed position are also viable and useful structures, but inherently require additional parts over the basic hinge.

SUMMARY OF THE INVENTION

It is a principal object of the invention herein to provide an improved hinge of polypropylene or the like for hingedly connecting the cover and box portions of a plastic container made of polystyrene or the like wherein the hinge achieves secure self-attachment to the cover and box portions of the plastic container.

It is another principal object of the invention herein to provide an improved hinge of polypropylene or the like for hingedly connecting the cover and box portions of a plastic container made of polystyrene or the like wherein the hinge includes means releasably detaining the cover in a closed position.

According to the invention herein, a polystyrene foam container comprises a cover and a box portion which are hingedly connected by a pair of one-piece hinges. According to one aspect of the invention herein, the hinges achieve secure self-attachment to the cover and box, and according to another aspect of the invention herein, the hinges include integral means for releasably detaining the cover and box portions of the container in their closed position.

More particularly, the container comprises a cover and a box portion, the box portion being open-topped and having a bottom and upstanding sidewalls. At least one of the sidewalls is of substantial thickness. The cover is sized to close the open top of the box, and rests upon the tops of the upstanding sidewalls. Two openings are disposed along the top of the thick sidewall of the box, and corresponding openings are formed in the cover such that the cover openings and box openings are juxtaposed when the cover is positioned on the box.

A flexible hinge connects the cover and box of the container, the flexible hinge comprising two hinge plates connected by an integral flexible web disposed across the juxtaposed edges of the cover and box. Each of the hinge plates is provided with a U-shaped hinge mount which are received in the openings of the box and cover for mounting the hinge thereto, the hinge mount comprising a first downwardly extending leg connected to the hinge plate, a bottom leg and an upwardly extending flange leg terminating in an outwardly extending anchoring flange. A rib connects the two legs and prevents them from bending toward each other. Thus, as the U-shaped hinge mount is inserted into its respective opening, in which it is generally matingly received, the flange deforms the soft polystyrene. Once the hinge mount is in position, the flange creates a secure interengaging fit holding the hinge mount in the opening, wherein the hinge is easily and securely self-attached to the box and cover of the container.

The hinge according to the invention herein provides for releasably detaining the cover in a closed position on the box, in order that the container might remain closed. This is accomplished by at least one integral locking leg extending from one of the hinge plates, the locking leg positioned and configured to releasably engage the other hinge plate when the hinge plates are closed together, i.e. when the cover is closed on the box. In the preferred embodiment, one of the hinge plates has two upstanding integral locking legs between which the other hinge plate is received, and the integral locking legs include capture tabs for detaining the second hinge plate in its closed position with respect to the first hinge plate. A moderate amount of force exerted on the cover will release the captured hinge plate from the integral locking legs, so that the container may be opened.

Other and more specific features and objects of the invention will in part be obvious and will in part appear from a perusal of the following description of the preferred embodiment and the claims taken together with the drawings.

DRAWINGS

The same reference numbers refer to the same elements throughout the various Figures.

DESCRIPTION OF THE PREFERRED EMBODIMENT

Figure 1:
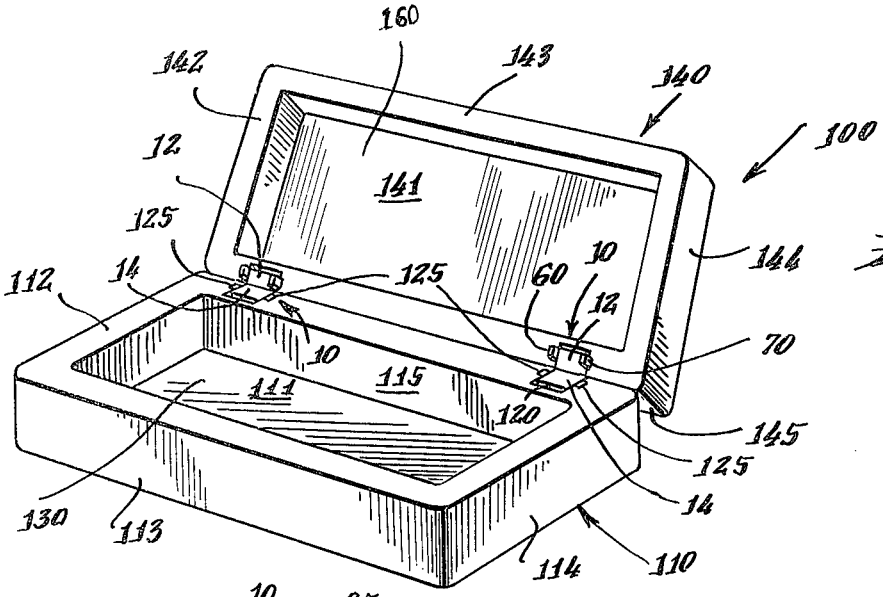
FIG. 1 is a perspective view of a container comprising a box and cover connected by hinges according to the invention herein.
Figure 2:
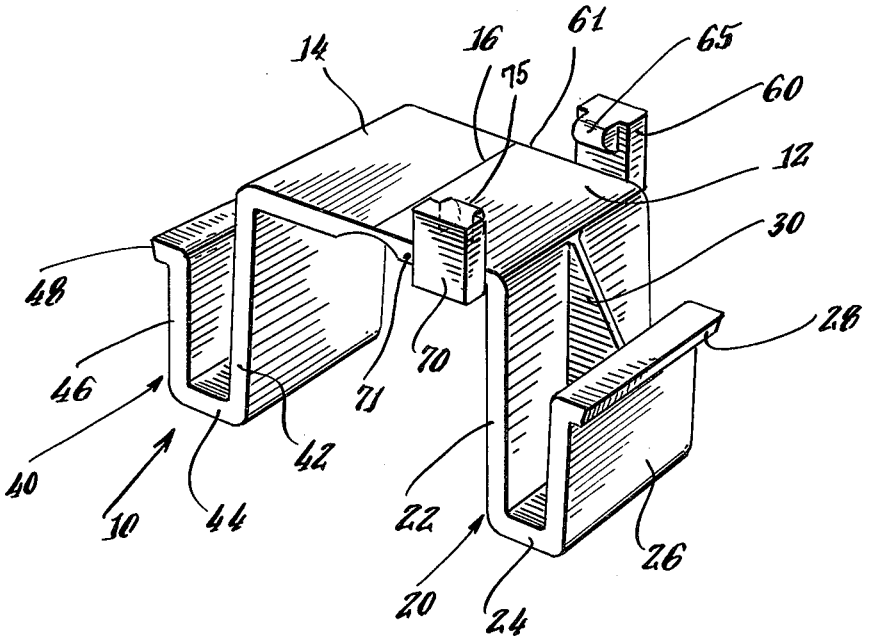
FIG. 2 is an enlarged perspective view of one of the hinges of FIG. 1.

A preferred embodiment of a hinge 10 is shown in FIG. 2, and the hinge 10 is shown connecting the box 110 and cover 140 of a container 100 in FIGS. 1 and 3–5, all according to the invention herein.

Referring particularly to FIG. 2, the hinge 10 is comprised of generally rectangular hinge plates 12 and 14 connected for relative bending movement by a thin, integral hinge web 16. Hinge plate 12 is provided with an integral hinge mount 20, the hinge mount 20 being generally U-shaped when viewed from the side and comprising a depending leg 22, a bottom leg 24, and a flange leg 26 generally parallel to the depending leg 22. The flange leg 26 is characterized by an outwardly protruding flange 28, and the flange leg 26 is preferably approximately one-half of the length of the depending leg 22. A thin but rigid rib 30 extends between the legs of the hinge mount 20, and the web 30 maintains the spacing between the depending leg 22 and the flange leg 26, such that the flange leg 26 does not yieldingly bend toward the leg 22 during mounting of the hinge, as will be more fully explained below. Hinge plate 14 is also provided with an integral hinge mount 40, which is a mirror image of the hinge mount 20 of hinge plate 12. More particularly, the hinge mount 40 comprises a depending leg 42, a bottom leg 44 and an upstanding flange leg 46 terminating in an outwardly disposed flange 48, with the spacing between the depending leg 42 and the flange leg 46 being maintained by a rib 50.

The hinge 10 is shown "open" in FIG. 2. When the hinge 10 is closed, the hinge plates 12 and 14 are folded over at hinge web 16 to lie adjacent to each other, and the hinge 10 further includes means for releasably detaining it in its closed position. To this end, hinge plate 12 is provided with a pair of upstanding locking legs 60 and 70. Locking leg 60 is mounted to, preferably by being integral with, hinge plate 12 along the side edge 61 thereof, the edge 61 being disposed generally at right angles with the hinge web 16. The locking leg 60 is provided with an inwardly extending capture tab 65 disposed above the top surface of hinge plate 12 by a distance approximately equal to the thickness of hinge plate 14. Locking leg 70 is located and mounted on edge 71 of the hinge plate 12 opposite locking leg 60, and locking leg 70 includes an inwardly extending capture tab 75. Capture tab 75 is also disposed above the hinge plate 12 by a distance approximately equal to the thickness of hinge plate 14. As the hinge 10 is closed, hinge plate 14 passes between the locking legs 60 and 70, deflecting them outwardly, and when the hinge 10 is closed, hinge plate 14 is releasably held adjacent hinge plate 12 by the capture tabs 65 and 75.

Referring now to FIG. 1, a container 100 is comprised of a box 110 having a bottom 111 and sidewalls 112–115 defining a cavity 130 in which contents may be placed. The container 100 further comprises a cover 140 having a top 141 and sidewalls 142–145, and the cover 140 may define a cavity 160 which joins with the cavity 130 of the box 110 when the container 100 is closed. Two of the hinges 10 shown in FIG. 2 are mounted to the sidewall 115 of the box 110 and also to the sidewall 145 of the cover 140 to hingedly connect the box and the cover such that the cover may be pivoted between its open and closed positions, and the hinges 10 further releasably detain the cover in its closed position.

Figure 3:
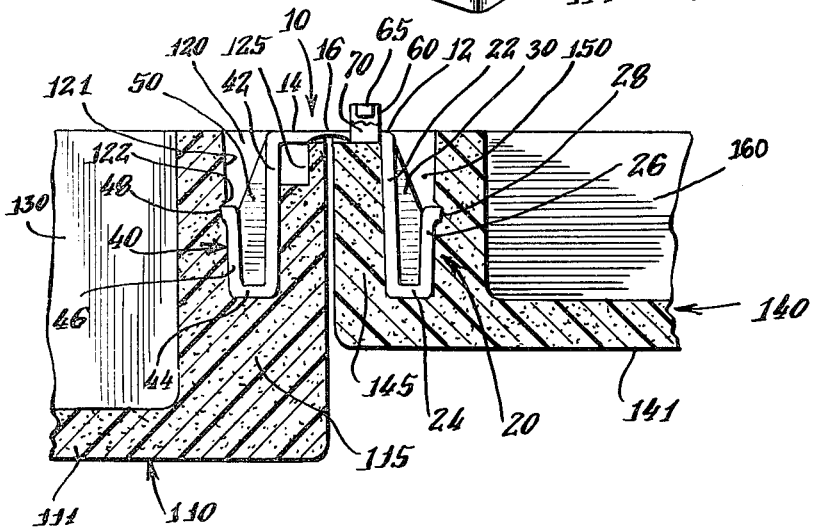
FIG. 3 is an enlarged cross-sectional view of the container of FIG. 1 with the container open, taken adjacent one of the hinges.

With reference to FIG. 3, the sidewall 115 of the box 110 is substantially thick and is provided with an opening 120 which generally matingly receives the hinge mount 40 of the hinge 10. The sidewall 145 of the cover 140, also substantially thick, defines an opening 150 which generally matingly receives the hinge mount 20 of the hinge 10. "Substantially thick" means that the portions of the sidewalls flanking the hinge mount receiving openings are thick enough to support the hinge mounts without breaking.

The hinge mounts 20 and 40 are pressed into the respective openings 120 and 150, and are self-attached therein. More particularly, the sidewall 121 of opening 120 is initially smooth and straight, and is deformed by the downward passage of flange 48 into the opening 120. The flange leg 46 and flange 48 are held spaced apart from and prevented from collapsing inwardly toward the opposite depending leg 42 by the rib 50. Foam polystyrene material from which the container 100 is preferably fabricated is somewhat soft and resilient and, as shown in FIG. 3, returns to its original shape after the flange 48 has passed. However, when the hinge mount 40 is fully seated in opening 120, the flange 48 creates a mating notch 122 in the sidewall 121 of opening 120 in which the flange 48 is interengagingly received. The hinge mount 20 is received in a similar manner in the opening 150 defined by the sidewall 115 of the cover 140.

Still referring to FIG. 3, the flexible hinge web 16 closely adjoins the cover and the box, and the tops of the sidewalls 115 and 145 of the box 110 and cover 140, respectively, are recessed as shown to accommodate the hinge plates 12 and 14.

Referring again to FIG. 1, the two hinges 10 are shown connecting the cover 140 to the box 110 of the container 100. It will be appreciated that the second hinge 10 shown in FIG. 1 is mounted to the box and cover by additional openings 120 and 150. As also seen in FIG. 1, the openings 120 include notched portions 125 flanking the hinge plate 14, the notches 125 being provided to accommodate the locking legs 60 and 70 when the container is closed.

Figure 4:
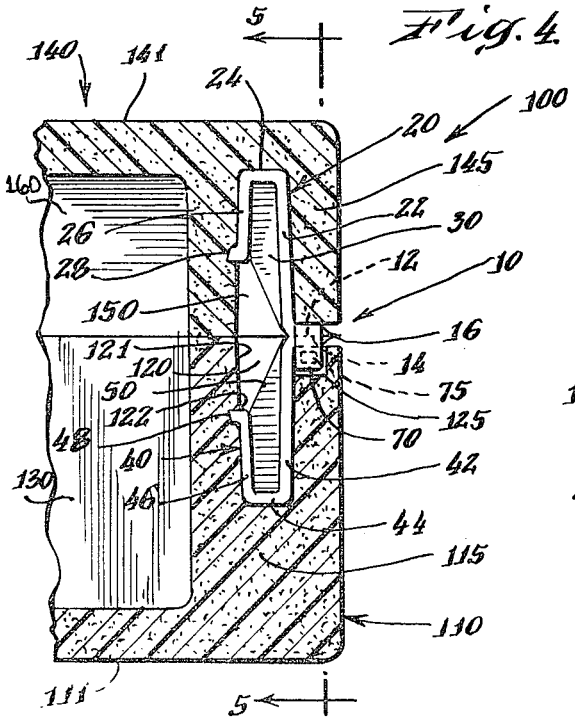
FIG. 4 is an enlarged cross-sectional view of the container and hinge of FIG. 1, similar to FIG. 3 but with the container closed.
Figure 5:
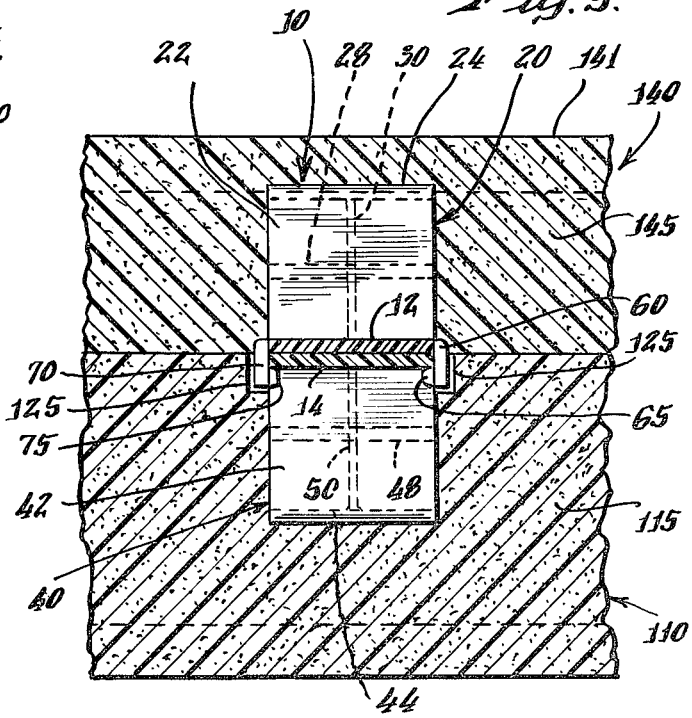
FIG. 5 is an enlarged cross-sectional view of the container and hinge of FIG. 1 taken along the lines 5—5 of FIG. 4.

Sectional views of the container 100 in its closed position with the cover 140 positioned over the box 110 are shown in FIGS. 4 and 5. The hinge 10 is folded at the hinge web 16, and the hinge plates 12 and 14 lie against each other. The locking legs 60 and 70 act to releasably hold the cover 140 in its closed position. In particular, as best seen in FIG. 5, the hinge plate 14 is captured under the capture tabs 65 and 75 of the locking legs 60 and 70, respectively, wherein the hinge plate 14 is held adjacent the hinge plate 12 to maintain the cover 140 in its closed position. The integral locking legs 60 and 70 are somewhat flexible, and yield to permit hinge plate 14 to pass between the capture tabs 65 and 75 as the cover 140 is opened and closed. FIG. 5 also illustrates the notches 125 of the opening 120 in sidewall 115 of the box 110, the notches 125 accommodating the integral locking legs 60 and 70. Of course, the locking tabs could be provided on hinge plate 14 to capture hinge plate 12, and the notches 125 could be provided in the cover opening 150, if desired.

The container 100 is preferably fabricated of foamed polystyrene and particularly may be molded from polystyrene beads. The container is thus light weight, substantially rigid, and yet locally deformable such that the hinge flanges can be inserted and seat in the manner described above. The hinge 10, including the integral locking legs 60 and 70 and the hinge web 16, is preferably fabricated of polypropylene, which results in a substantially rigid structure which is sufficiently flexible for locking legs to yield and releasably detain the hinge in its closed position, as also described above. The suitability of polypropylene for use in a "living" hinge structure is well-known.

It will be appreciated that other configurations of the locking legs can be utilized, and the thrust of the invention herein is to provide a locking leg which achieves releasable interengagement between the hinge plates in order to permit the cover and box connected by the hinge to open and close and to releasably detain them in their closed position. It will also be appreciated that the locking legs of the invention herein can be incorporated in other hinges, such as the hinges shown in U.S. patent application Ser. No. 822,416, now U.S. Pat. No. 4,089,467, or in hinges which are attached to the containers by means other than the hinge mounts described in that patent or in this patent application. It will further be appreciated that the locking legs can be supplemented by latch members, such as shown in U.S. application Ser. No. 822,416, now U.S. Pat. No. 4,089,467, if additional security against accidental opening of the container is desired.

Accordingly, a hinge which is self-attaching in containers and which includes means for releasably detaining the container cover in its closed position has been described, and it is believed to admirably achieve the objects of the invention herein. Changes from the preferred embodiment disclosed herein may be made by those skilled in the art without departing from the spirit and scope of the invention, which is limited only by the following claims.

I claim:

1. A hinge for hingedly connecting the box and cover of a container or the like, the container fabricated of a locally yieldable plastic material, such as polystyrene foam, the hinge comprising two hinge plates connected for hinge-folding relative movement by an integral thin flexible hinge web, each hinge plate having an integral generally U-shaped hinge mount including a leg depending from the hinge plate opposite and spaced apart from the hinge web and an integral bottom leg connecting the depending leg with an integral flange leg juxtaposed the depending leg and spaced apart therefrom, means for maintaining the flange leg and the depending leg spaced apart, and a hinge flange disposed outwardly from the flange leg, wherein the box and cover each define an opening for generally matingly receiving one of the hinge mounts except for the hinge flange, which yieldingly deforms the material forming the opening to create a notch therein in which the hinge flange is received in an interengaging fit, whereby inserting one of the hinge mounts into the box opening and the other of the hinge mounts in the cover opening self-attaches the hinge to the box and cover and hingedly connects them.

2. A hinge as defined in claim 1 wherein the flange leg is shorter than the depending leg.

3. A hinge as defined in claim 2 wherein the means maintaining the flange leg and the depending leg spaced apart comprises an integral rib connecting the legs of the hinge mount.

4. A hinge as defined in claim 3 wherein the hinge flange is positioned at the end of the flange leg.

5. A hinge as defined in claim 4 wherein the flange leg is approximately one-half the length of the depending leg.

6. A hinge as defined in claim 1 wherein the depending legs are approximately perpendicular their respective hinge plates.

7. A hinge as defined in claim 1 and further comprising a locking leg integral with one of the hinge plates and configured for a releasable interengaging fit with the other of the hinge plates when the hinge is in its closed position with the hinge plates folded together and adjacent each other, the locking leg thereby releasably detaining the hinge in its closed position.

8. A hinge as defined in claim 1 and further comprising two locking legs each integral with and upstanding from one of the hinge plates, the two locking legs positioned to receive the other hinge plate therebetween when the hinge is in its closed position with the hinge plates folded together and adjacent each other, the locking legs each having a capture tab engaging the other hinge plate and holding the hinge in its closed position, the locking legs being sufficiently flexible to permit the other hinge plate to pass between the capture tabs, the locking legs thereby releasably detaining the hinge and the box and cover connected by the hinge in a closed position.

9. A hinge as defined in claim 5 and further comprising two locking legs each integral with and upstanding from one of the hinge plates, the two locking legs positioned to receive the other hinge plate therebetween when the hinge is in its closed position with the hinge plates folded together and adjacent each other, the locking legs each having a capture tab engaging the other hinge plate and holding the hinge in its closed position, the locking legs being sufficiently flexible to permit the other hinge plate to pass between the capture tabs, the locking legs thereby releasably detaining the hinge and the box and cover connected by the hinge in a closed position.

10. A hinge as defined in claim 9 wherein the hinge is fabricated of polypropylene.

11. A hinge for hingedly connecting the box and cover of a container or the like and for releasably detaining the box and cover in their closed position, the hinge comprising two hinge plates connected for hinge-folding relative movement by an integral thin hinge web, the hinge plates having means for respectively attaching them to the box and cover of the container, one of the hinge plates having at least one locking leg integral therewith and configured for a releasable interengaging fit with the other of the hinge plates when the hinge is in its closed position with the hinge plates folded together and adjacent each other, whereby the locking leg releasably detains the hinge, and thereby the box and cover, in a closed position.

12. A hinge as defined in claim 11 wherein there are two locking legs integral with and upstanding from one of the hinge plates, the two locking legs positioned to receive the other hinge plate therebetween when the hinge is in its closed position, the locking legs each having a capture tab engaging the other hinge plate and holding the hinge in its closed position, the locking legs being sufficiently flexible to permit the other hinge plate to pass between the capture tabs, the locking legs thereby releasably detaining the hinge in its closed position.

13. A hinge as defined in claim 12 wherein the hinge is fabricated of polypropylene.

14. A hinge integrally fabricated of polypropylene and comprising two hinge plates connected for hinge-folding relative movement by a thin flexible hinge web, each hinge plate having a generally U-shaped hinge mount comprising a leg depending from the hinge plate opposite the hinge web and a bottom leg connecting the depending leg with a flange leg juxtaposed the depending leg and maintained spaced-apart therefrom by a rib extending therebetween, the flange leg being shorter than the depending leg and having a flange at the end thereof, the flange protruding outwardly from the flange leg and away from the depending leg.

15. A hinge as defined in claim 14 and further comprising two locking legs upstanding from one of the hinge plates, the locking legs respectively positioned along the edges of the hinge plate extending between the hinge web and the depending leg of the U-shaped hinge mount for receiving the other hinge plate therebetween when the hinge is in its closed position, the locking legs each having a capture tab engaging the other hinge plate and holding the hinge in its closed position, the locking legs being sufficiently flexible to permit the other hinge plate to pass between the capture tabs, the locking legs thereby releasably detaining the hinge in its closed position.

16. A polystyrene container comprising a box and a cover, the box having two hinge-receiving openings disposed along a sidewall thereof and the cover having two corresponding hinge-receiving openings, the respective box and cover hinge-receiving openings being positioned adjacent when the cover is closed relative to the box, and two hinges hingedly connecting the box and the cover, each hinge being integrally fabricated of polypropylene and comprising two hinge plates connected for hinge-folding relative movement by a thin flexible hinge web, each hinge plate having a generally U-shaped hinge mount comprising a leg depending from the hinge plate and a bottom leg connecting the depending leg with a flange leg juxtaposed the depending leg and maintained spaced-apart therefrom by a rib connecting the legs, the flange leg being shorter than the depending leg and having a flange at the end thereof, the flange protruding away from the depending leg, wherein the hinge mounts are respectively generally matingly received in the hinge-receiving openings in the box and cover with the flanges yieldingly deforming the openings to create notches therein receiving the flanges in an interengaging fit, whereby the hinges self-attach to the box and cover and hingedly connect them.

17. A hinge as defined in claim 16 and further comprising two locking legs each integral with and upstanding from one of the hinge plates, the two locking legs positioned to receive the other hinge plate therebetween when the hinge is in its closed position with the hinge plates folded together and adjacent each other, the locking legs each having a capture tab engaging the other hinge plate and holding the hinge in its closed position, the locking legs being sufficiently flexible to permit the other hinge plate to pass between the capture tabs, the locking legs thereby releasably detaining the hinge and the box and cover connected by the hinge in a closed position.

* * * * *